US006467389B1

(12) United States Patent
Baus et al.

(10) Patent No.: US 6,467,389 B1
(45) Date of Patent: Oct. 22, 2002

(54) ARTILLERY-SHELL RAMMER

(75) Inventors: Rüdiger Baus, Vellmar; Thomas Kneisel, Kassel; Karl Lieberum, Niedenstein, all of (DE)

(73) Assignee: Krauss-Maffei Wegmann GmbH & Co. KG, Kessel (DE)

( * ) Notice: Subject to any disclaimer, the term of this patent is extended or adjusted under 35 U.S.C. 154(b) by 0 days.

(21) Appl. No.: 09/708,144

(22) Filed: Nov. 8, 2000

(30) Foreign Application Priority Data

Nov. 17, 1999 (DE) ..... 199 55 234

(51) Int. Cl.[7] ..... F41A 9/42
(52) U.S. Cl. ..... 89/47
(58) Field of Search ..... 89/46, 47, 33.05

(56) References Cited

U.S. PATENT DOCUMENTS 3,602,089 A * 8/1971 Beaufrere ..... 89/47
4,555,972 A * 12/1985 Heyne ..... 89/8
4,957,028 A * 9/1990 Lieberum et al. ..... 89/47

FOREIGN PATENT DOCUMENTS

CH 664627 * 3/1988 ..... 89/47

* cited by examiner

*Primary Examiner*—Stephen M. Johnson
(74) *Attorney, Agent, or Firm*—Chadbourne & Parke, LLP

(57) ABSTRACT

An artillery-shell rammer with a carriage provided with a shell accommodation trough. The trough is aligned with the weapon's chamber behind the barrel and has a shell positioner at the rear. The carriage travels back and forth on a rail along a track paralleling the axis of the barrel and is coupled to a drive mechanism that accelerates it toward the barrel. Means of braking the carriage are provided at a prescribed distance back of the barrel. The drive mechanism is provided with at least one linear motor.

12 Claims, 6 Drawing Sheets

ARTILLERY-SHELL RAMMER

BACKGROUND OF THE INVENTION

The present invention concerns an artillery-shell rammer with a carriage provided with a shell-accommodation trough aligned with the weapon's chamber behind the barrel and having a shell positioner at the rear, wherein the carriage travels back and forth on a rail along a track paralleling the axis of the barrel and is coupled to a drive mechanism that accelerates it toward the barrel, and wherein means of braking the carriage are provided at a prescribed distance back of the barrel.

A shell rammer of this genus, a "free-flight" rammer, is known from European Published Application 0 352 584 A2 for example.

The principle of a free-flight shell rammer is that a shell outside the weapon can be accelerated to the extent that, once it has left the accelerating system, it will continue moving in free flight due to the kinetic energy provided thereby and accordingly rammed into position. The accelerating system employed in the free-flight shell rammer disclosed in the aforesaid publication, and in CH 684 627 as well for example, includes a carriage. A shell is laid in the carriage and is accelerated along with it. Upon attaining sufficient velocity, the carriage is braked. The shell flies through the weapon's breechblock and into the chamber and rams in at the barrel's grooves.

Artillery weapons usually do not have a take-off ramp long enough to accelerate the carriage and its load to the velocity needed to ram the shell. Rapid accelerations must be obtained by calculating from the available strip and from the prescribed velocity. To accelerate the existing masses (the carriage and the shell) absolutely requires a powerful impact, which must be applied suddenly. Hence, a high energy density must be briefly accessible for the acceleration procedure.

Known free-flight shell rammers employ pneumatic (U.S. Pat. No. 4,957,028) or hydraulic (CH 664 627) drives equipped with piston-and cylinder mechanisms.

The fluid is stored in a reservoir and provided instantaneously to the drive through a special valve.

The requisite pneumatic or hydraulic pressure is generated by a motor-powered compressor or hydraulics assembly.

The electric energy is converted into another form, demanding considerable expenditure to process and store and entailing considerable loss of efficiency.

Also known are free-flight shell rammers driven by resilient energy accumulators, motor-compressed helical springs or gas bladders for instance, mechanically released to initiate acceleration and forward the requisite energy by way of downstream components (chains or racks e.g.) to the shell or carriage.

SUMMARY OF THE INVENTION

The object of the present invention is accordingly an improved shell rammer for the artillery of the type hereinbefore wherein electrical energy is converted directly into kinetic energy within the drive mechanism, eliminating the loss of efficiency characteristic of systems that convert electrical energy into another form.

The invention derives from the realization that it would be impossible to build a conventional electrically powered drive mechanism that could generate enough energy at once to propel the carriage straight forward at precisely the instant the shell is to be rammed. Converting the rotary motion characteristic of conventional motors rapidly enough into the translatinal motion required by the carriage would strain the components (chains, shafts, cogwheels, and racks) generally employed to build such machinery to the limits of their endurance, given the inertia of the masses that have to be instantaneously accelerated. Furthermore, the mere size and weight of a motor theoretically powerful enough to accomplish the task would almost entirely prevent its installation in a combat vehicle, on a moving loading arm for instance.

This object is attained in accordance with the present invention in a shell rammer of the aforesaid genus in that the drive mechanism is provided with at least one linear motor.

It has been demonstrated especially practical for the motor's primary section, the section the electric current is supplied to, that is, to be fastened stationary to the carriage track and for the secondary section to be fastened stationary to the carriage.

The secondary section can be a long and flat piece of ferromagnetic material with a magnetic strip embedded in it.

The basic theory of the present invention accordingly entails the use of a linear motor instead of the conventional drive mechanism consisting of a piston-and-cylinder mechanism. Linear motors will produce straight-line motions directly, without the intervention of transmissions. Force is accordingly exerted directly against the mass that is to be shifted. There are no intermediate mechanisms. Electrical energy is applied as such and need not be converted to another form.

Another advantage of a drive mechanism with a linear motor is that, in contrast to a piston-and-cylinder mechanism, which does not provide any forward motion until it has completed its stroke, both acceleration and braking can be very precisely controlled all through the stroke. The braking acceleration can for example be canceled or even reversed. A linear motor can accordingly generate an additional braking force, the strength of which can be established by the design of the carriage-braking means. As will be specified hereinafter with reference to the accompanying drawing, it will also be possible to dimension the motor and fasten it stationary to the carriage, ensuring that the motor's secondary section separates from its stator during the braking phase. The reduced overlap will automatically decrease the motor's forward impulsion.

When installed in a combat vehicle, the motor can be provided with electricity from a rechargeable battery supplied with current from the on-board power network. To ensure sufficiently rapid availability of enough power to effectively ram the shell, a temporary-storage reservoir with a capacity high enough to handle a single ramming procedure can be provided.

It will also be possible to mount electrical instruments and controls on the carriage to monitor the course if the procedure and provide additional power to the motor as needed.

This system of instrumentation also provides other advantages. It allows precise control of the distance traveled by the carriage as a function of time, of ramming rate as a function of elevation, and of propulsive force as a function of shell type, as well as of the braking procedure.

Various embodiments of a shell rammer in accordance with the present invention will now be specified with reference to the accompanying drawing, wherein

DETAILED DESCRIPTION OF THE INVENTION

Figure 1:
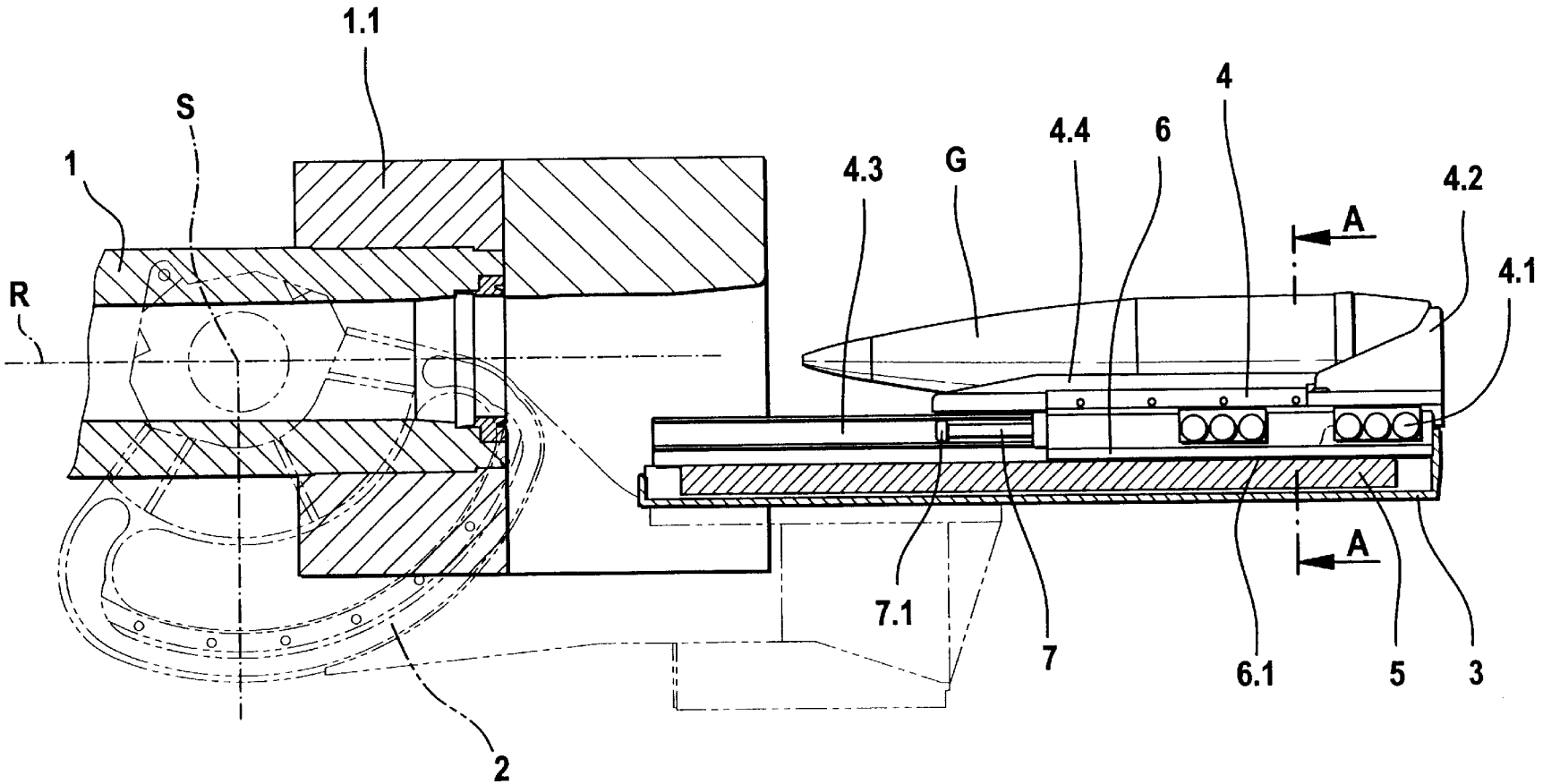
FIG. 1 is a longitudinal section through the rear of a gun barrel with a disengaged shell rammer.

FIG. 1 shows only the rear of the barrel 1 of an artillery weapon, the end, that is, with a breechblock 1.1. A shell-transfer arm 2 mounted on barrel 1 pivots up and down around trunnions S. Mounted on a beam 3 at the free end of shell-transfer arm 2 is a shell rammer. A carriage track 4.3 is secured to the top of shell rammer beam 3. A shell carriage 4 travels back and forth paralleling the barrel's axis R on rollers 4.1 along beam 3. On the rear of carriage 4 is a cup-shaped positioner 4.2 that travels along with a shell G and secures it in a trough 4.4 in the carriage. At the front of carriage 4 is an in-itself known and accordingly not further specified herein shock absorber 7. With carriage 4 in the farthest-back position illustrated in FIG. 2, the shell-contact surface 7.1 of shock absorber 7 rests against the rear of barrel R. When the shell is to be rammed, carriage 4 shifts out of the disengaged position illustrated in FIG. 1 and into the farthest-forward position illustrated in FIG. 2, wherein the first stage of that position is represented by continuous lines and its final stage by discontinuous lines. During and after braked, shell G will continue moving forward and into barrel 1 in free flight.

Figure 2:
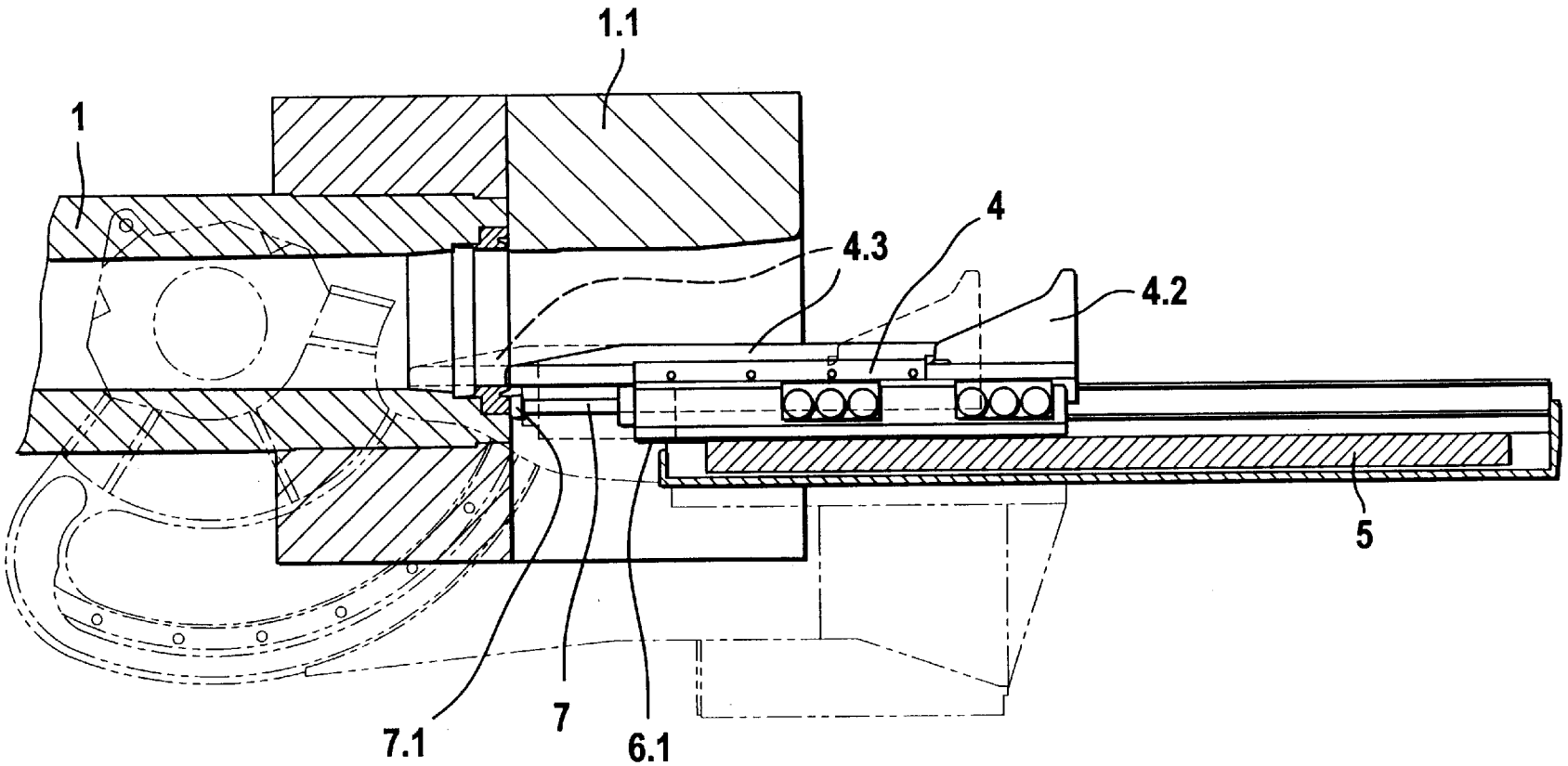
FIG. 2 is a similar section illustrating the rammer in the braking phase.
Figure 3:
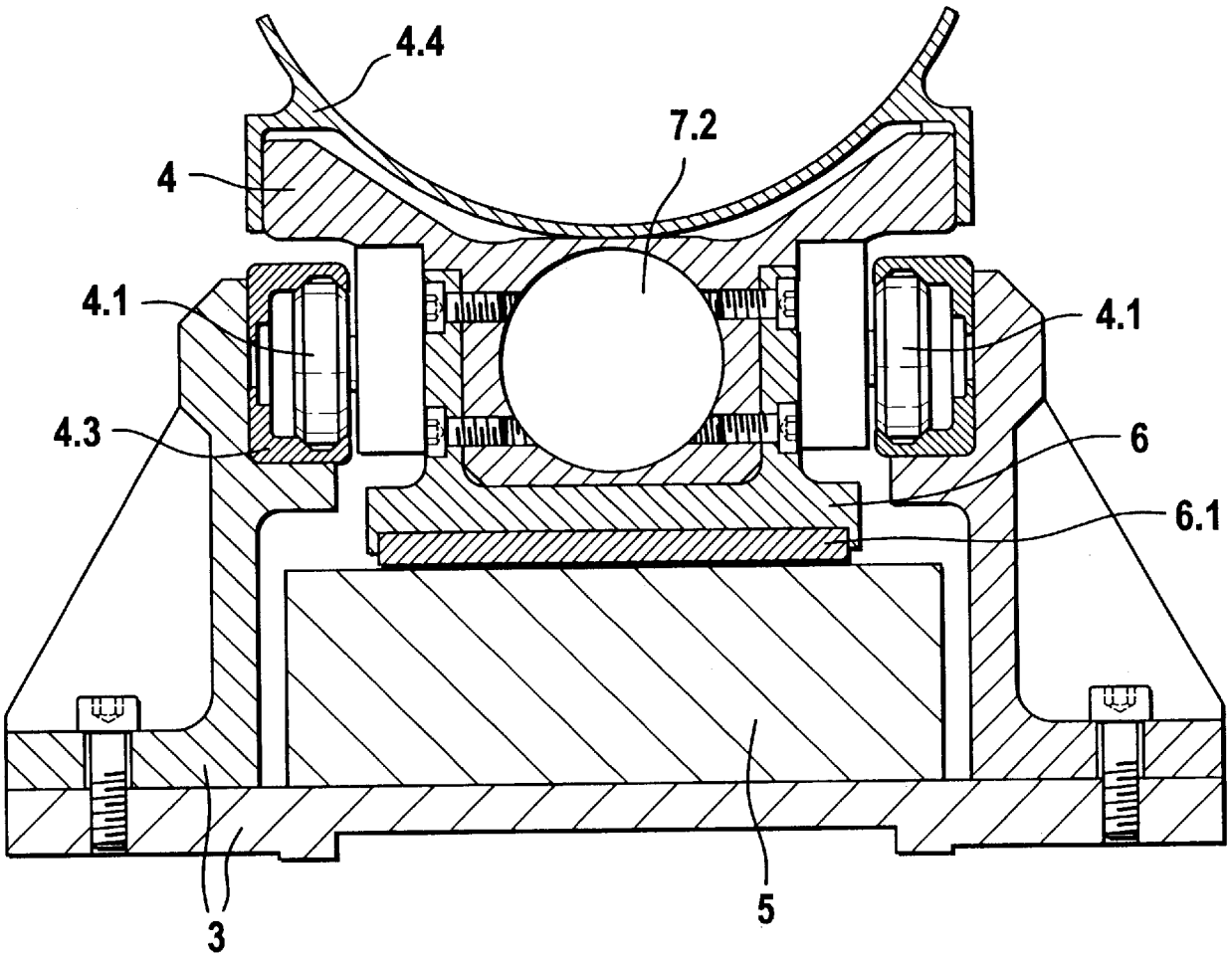
FIG. 3 is a slightly larger-scale transverse section through the rammer along the line A—A in FIG. 1.

The embodiment illustrated in FIGS. 1 through 3 of the drive mechanism that accelerates carriage 4 in accordance with the present invention includes a linear motor comprising a stationary primary section 5 and a movable secondary section 6. Primary section 5 is a long, flat structure extending from beam 3 to carriage 4. Primary section 5 is connected by unillustrated connections to the motor's source of electrical power.

Movable secondary section 6 is also a long, flat structure and is of ferromagnetic material, iron for example, and is provided with a magnetic strip embedded in it. Secondary section 6 can travel back and forth along primary section 5, generating a two-level attraction between the sections and propelling the secondary section forward with a momentum that must be accommodated by carriage assembly 4.1–4.3. The unillustrated shock absorber is accommodated in the space 7.2 represented in FIG. 3.

Figure 4:
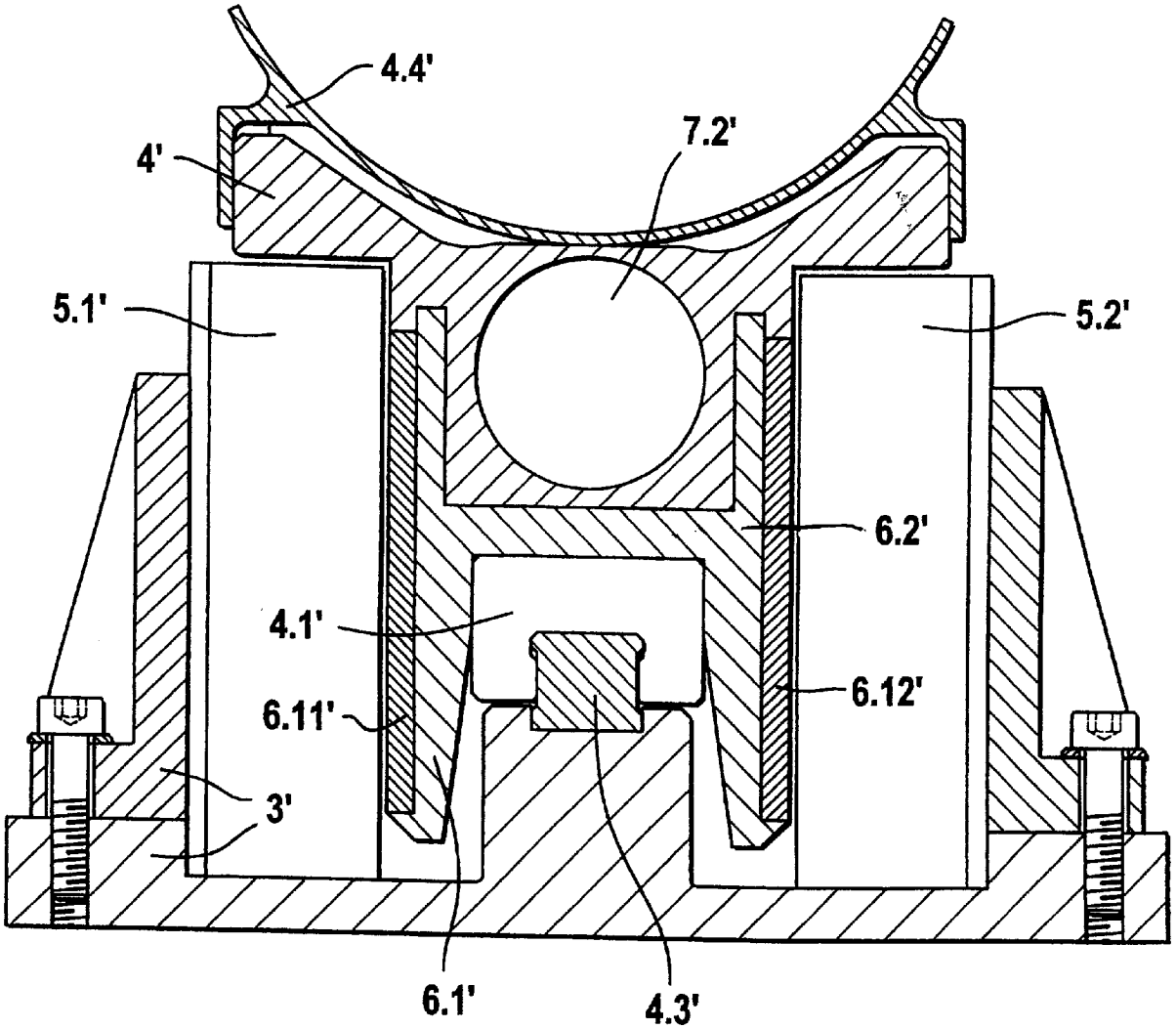
FIG. 4 is a section similar to FIG. 3 through a different embodiment of the rammer.

FIG. 4 illustrates a drive mechanism provided with two linear motors. Similar components are labeled with the same reference numbers employed in FIG. 3 primed.

The carriage 4' in this embodiment is mounted on the straight rail 4.1' of a central carriage track 4.3'. The motor's primary sections 5.1' and 5.2' are fastened stationary to a beam 3'. Facing the primary sections on each side of carriage 4' are outward-oriented components in the form of secondary sections 6.1' and 6.2' of ferromagnetic material, each with magnetic strip 6.11' and 6.12' embedded in it.

Since, however, they are still part of the overall carriage assembly, the carriage must be particularly rigid, The double-section system will of course also complicate manufacture. The lengths of the primary and secondary sections in the embodiment hereintofore specified can be varied to ensure that the take-off ramp will be long enough to adequately accelerate carriage 4 or 4' in the available space. Less propulsion will accordingly be needed to accelerate the carriage and its load during the instant of ramming, and the motor will need less power.

The length of the carriage itself can be abbreviated to match that of the secondary section or sections. This tactic will reduce weight.

The front of the shell-loading tray 4.4 or 4.4' mounted on carriage 4 or 4' will dip into the weapon's chamber as the carriage brakes (the stage represented by the discontinuous lines in FIG. 2). This approach will considerably facilitate the shell's downward motion as it "takes off" from carriage 4 or 4'.

Figure 5:
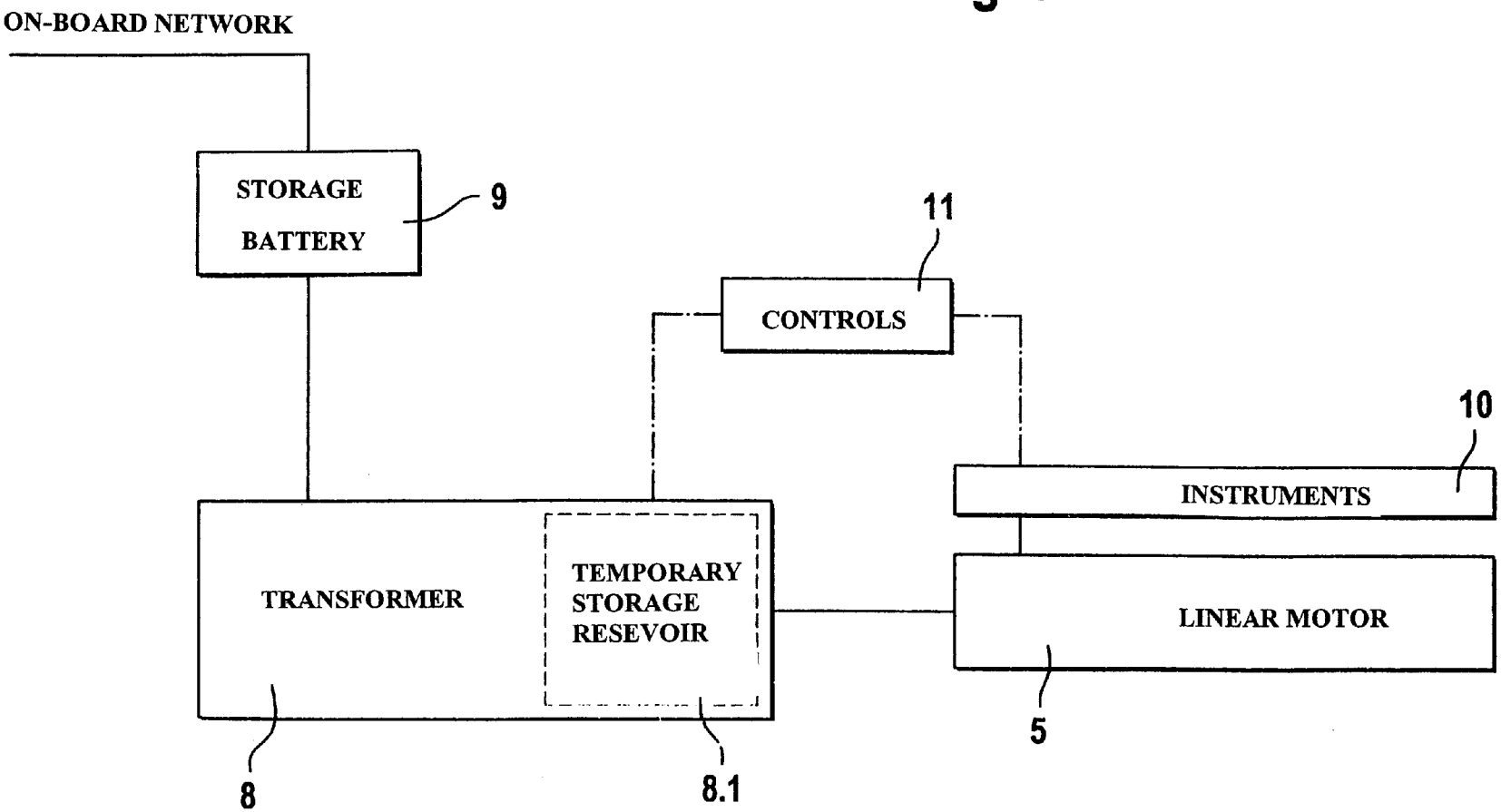
FIG. 5 is a block diagram of the system that provides electrical power to the rammer illustrated in FIGS. 1 through 4.

FIG. 5 illustrates a source of electrical power for the drive mechanism illustrated in FIGS. 1 through 4. This source includes a rechargeable battery 9 connected for example to the on-board electrical network. If the linear motor is a synchronous motor, the direct current must be transformed into the alternating current needed to operate it. This process is carried out by a transformer 8 connected to battery 9. Since considerable power must be provided instantaneously to effectively ram the shell, transformer 8 includes a temporary-storage reservoir 8.1 or capacitor with a capacity high enough to handle the ramming procedure.

Electrical instruments 10 mounted on carriage 4 or 4' monitor the course of the ramming procedure and vary by way of controls 11 the output of power to primary section 5 from temporary storage reservoir 8.1 as needed.

The controls can operate in accordance with any desired performance curves that will ensure effective acceleration and braking deceleration of the carriage during the various stages of the ramming process.

Figure 6:
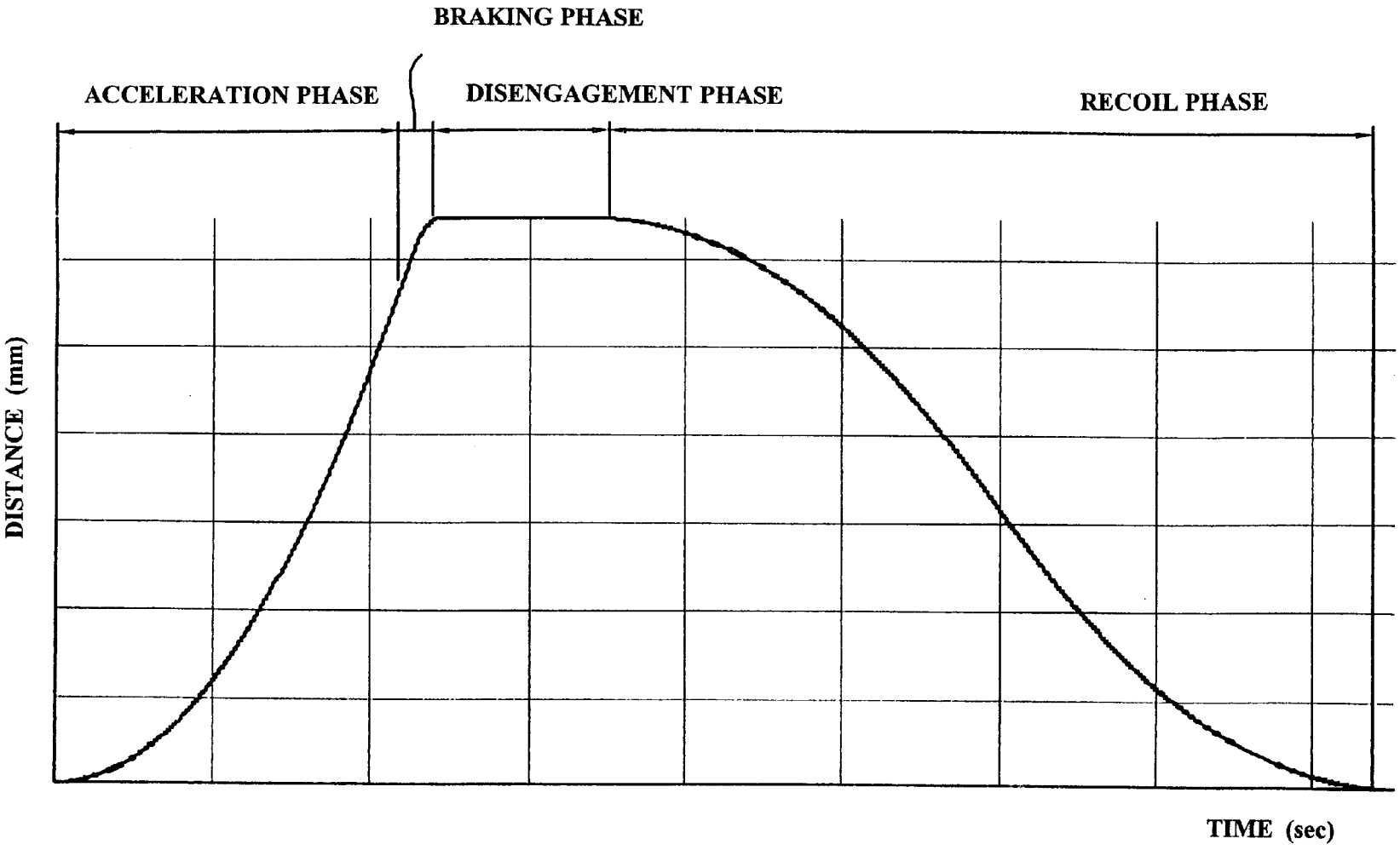
FIG. 6 is a graph illustrating the distance traveled by the carriage as a function of time.

FIG. 6 is a graph representing by way of example the distance traveled by the carriage as a function of time while the shell is being rammed. The graph illustrates both acceleration phase, a braking phase, a disengagement phase, and a recoil phase.

What is claimed is:

1. An artillery-shell rammer with a carriage comprising:

a shell accommodation trough aligned with a weapon chamber behind a barrel and having a shell positioner at the rear, wherein the carriage travels back and forth on a rail along a track paralleling an axis of the barrel and is coupled to a drive mechanism that accelerates said carriage toward the barrel, and wherein a carriage brake is provided at a prescribed distance behind the barrel, and wherein the drive mechanism comprises at least one linear motor, said linear motor having a primary section to which electric current is supplied and which is fastened stationary to the carriage track and a secondary section fastened stationary to the carriage.

2. The rammer as in claim 1, wherein the primary section of the linear motor is a long and flat component of a prescribed length longer than the secondary section.

3. The rammer as in claim 1, wherein the secondary section is a long and flat piece of ferromagnetic material with a magnetic strip embedded in it.

4. The rammer in claim 1, further comprising a system for supplying electricity to the linear motor including a temporary storage reservoir.

5. The rammer as in claim 4, said rammer installed in a combat vehicle, wherein said linear motor receives electricity from a rechargeable battery supplied with current from an on-board power network.

6. The rammer as in claim 4, wherein in the linear motor is a synchronous motor and the system for supplying electricity includes a direct-to-alternating current transformer.

7. The rammer as in claim 1, further comprising electric controls that control the action of the linear motor in accordance with the distance traveled by the carriage and/or with the aim and elevation of the weapon's barrel.

8. The rammer as in claim 7, wherein the controls are provided with instruments that measure the distance traveled and/or the aim and elevation of the weapon's barrel.

9. The rammer as in claim 7, wherein the carriage is braked at least to some extent by deceleration generated by the linear motor.

10. The rammer as in claim 1, wherein the linear motor has primary and secondary sections which are mounted such that the secondary section moves out of an effective range of the primary section once the carriage has traveled a specific distance.

11. The rammer as in claim 1, wherein the drive mechanism includes the linear motor with a flat primary section facing upward below the carriage and fastened stationary and a secondary section comprising a long, flat component fastened to the bottom of the carriage.

12. The rammer as in claim 1, wherein the drive mechanism comprises two linear motors with primary sections fastened stationary one on each side of the carriage, and secondary sections in the form of long, flat components fastened to the bottom of the carriage.

* * * * *